US006536364B1

(12) United States Patent
McDermott

(10) Patent No.: US 6,536,364 B1
(45) Date of Patent: Mar. 25, 2003

(54) MOORING APPARATUS

(76) Inventor: David Ken McDermott, 13 Stillwater, Crescent, Silverdale, Auckland (NZ)

( * ) Notice: Subject to any disclaimer, the term of this patent is extended or adjusted under 35 U.S.C. 154(b) by 0 days.

(21) Appl. No.: 10/019,476

(22) PCT Filed: Jun. 28, 2000

(86) PCT No.: PCT/NZ00/00113

§ 371 (c)(1),
(2), (4) Date: Dec. 31, 2001

(87) PCT Pub. No.: WO01/00481

PCT Pub. Date: Jan. 4, 2001

(30) Foreign Application Priority Data

| | | |
|---|---|---|
| Aug. 25, 1999 | (NZ) | 337428 |
| Jun. 29, 1999 | (NZ) | 336516 |
| Jan. 27, 2000 | (NZ) | 502540 |

(51) Int. Cl.[7] ..... B63B 21/00
(52) U.S. Cl. ..... 114/230.2; 114/293; 441/23
(58) Field of Search ..... 114/293, 294, 114/230.1, 230.12, 230.2, 326; 441/1–6, 84, 85, 23–26; 43/43.1, 43.11, 43.12, 42.22, 42.23, 42.35, 42.39, 44.91, 44.95

(56) References Cited

U.S. PATENT DOCUMENTS

| | | | | | |
|---|---|---|---|---|---|
| 3,101,491 | A | * | 8/1963 | Salo | 441/23 |
| 3,295,489 | A | * | 1/1967 | Bossa | 114/294 |
| 3,757,370 | A | * | 9/1973 | Seno et al. | 441/133 |
| 4,058,049 | A | | 11/1977 | Bech | 87/8 |
| 4,090,463 | A | | 5/1978 | Söderberg | 114/294 |
| 4,342,277 | A | | 8/1982 | Sluys | 114/293 |
| 4,506,622 | A | * | 3/1985 | Linehan et al. | 114/230.12 |
| 4,563,972 | A | * | 1/1986 | Poppe | 114/293 |
| 4,597,351 | A | * | 7/1986 | Brainard, II | 267/74 |
| 4,739,800 | A | * | 4/1988 | Baratella | 138/103 |
| 4,901,287 | A | * | 2/1990 | Hathaway et al. | 367/3 |
| 5,168,823 | A | * | 12/1992 | Sheppard, Jr. | 114/230.26 |
| 5,222,453 | A | * | 6/1993 | Chabot | 114/230.22 |
| 5,341,758 | A | * | 8/1994 | Strickland | 114/253 |
| 6,055,923 | A | | 5/2000 | Militzer | 114/210 |
| 6,085,628 | A | * | 7/2000 | Street et al. | 87/7 |

FOREIGN PATENT DOCUMENTS

| | | |
|---|---|---|
| DE | 3144728 A1 | 5/1983 |
| FR | 2410078 | 6/1979 |
| GB | 2317153 A | 3/1998 |
| WO | WO99/66169 | 12/1999 |

OTHER PUBLICATIONS

Derwent Abstract of DE 29813897 U1 (Rud–Kettenfabrik Rieger et al), Dec. 9, 1999.
Derwent Abstract of SU 1092236A (Astrakhan Fish Ind), May 15, 1984.

* cited by examiner

*Primary Examiner*—S. Joseph Morano
*Assistant Examiner*—Ajay Vasudeva
(74) *Attorney, Agent, or Firm*—Jacobson Holman PLLC

(57) ABSTRACT

Disclosed is a method and apparatus for mooring that provides an alternative to the chain traditionally used in mooring installations. It provides a flexible tie member to couple vessels to permanently located anchors which simulates the action of a mooring chain, but which is more durable and where the weights used in the apparatus may be reusable. The mooring apparatus comprises or includes, a flexible or articulable elongate member having a first end and a second end, and plurality of weights each secured and spaced along the elongate member, the first end adapted to be connected to an anchor weight and the second end adapted to be connected to a buoy. The method comprises using the mooring apparatus to moor a vessel.

21 Claims, 5 Drawing Sheets

MOORING APPARATUS

This is a nationalization of PCT/NZ00/00113 filed Jun. 28, 2000 and published in English.

BACKGROUND TO THE INVENTION

1. Field of the Invention

The present invention relates to a mooring apparatus and methods of providing moorings, in particular to moor boats, vessels or navigational buoys or the like.

2. Description of the Prior Art

The mooring of ships, buoys and other floating objects can be provided by merely tying one end of a rope or cable to the object to be moored, the other end of such rope or cable being secured to an anchor or other fixed point. Although effective under ordinary circumstances, the tethering member may fail under highly adverse weather conditions, and, in any event the moored object is usually free to drift about the fixed point to which the rope or cable is attached.

Alternatively, and most traditionally used, mooring buoys are anchored offshore by way of a chain that is connected to a weight providing anchoring of the chain, the other end of the chain being connected to a floating buoy. The buoy is usually strapped to a non-metallic cable, such as a hawser. When a vessel is to be moored the hawser is passed through a fairlead on a vessel and fixed to a bollard on the deck of the vessel. A problem with this type of mooring system is that the chain is susceptible to corrosion over time, especially in salt water, therefore regular checking and changing of the chain and detachment from the anchor weight is required.

SUMMARY OF THE INVENTION

Accordingly the present invention has as an object the provision of alternative apparatus for anchoring mooring buoys that is durable and reusable.

In a first aspect the invention consists in mooring apparatus comprising or including:

a flexible, continuous, jointless elongate member encased within a flexible tube having a first end and a second end, and a plurality of weights each secured and spaced along said tube encased elongate member, said first end adapted to be connected to an anchor weight and said second end adapted to be connected to a buoy, wherein said tube encased elongate member has a plurality of spacing means interspersed between said weights.

In a second aspect the invention consists in a method of forming mooring apparatus which comprises the steps of:

a) taking a flexible, continuous, jointless elongate member encased within a flexible tube having a first end and a second end and locating thereon a plurality of weights, b) attaching to said first end of said tube encased elongate member and anchor weight, and c) attaching to said second end of said tube encased elongate member a buoy.

In a third aspect the invention consists in, in combination, mooring apparatus as previously defined, and an anchor weight connected to one end thereof and a buoy connected to the other end thereof.

In a fourth aspect the invention consists in a method of providing a mooring comprising or including:

securing to a line or lines one end of at least one flexible, continuous, jointless elongate member encased within a flexible tube having two ends and a plurality of weights each secured and spaced along said elongate member, securing to the other end of said at least one tube encased elongate member an anchor weight, and securing the line or lines to at least one buoy, which upon hauling onto a vessel enables the said at least one tube encased elongate member to be secured to the vessel.

In a fifth aspect the invention consists in a mooring apparatus comprising or including:

a plurality of flexible, continuous, jointless elongate members encased within a flexible tube having first ends and second ends, wherein a plurality of weights is each secured and spaced along each of said tube encased elongate members, and said first ends of each of said plurality of tube encased elongate members are adapted to be connected to a respective one of a plurality of anchor weights and said second ends of said plurality of tube encased elongate members are adapted to be connected to a vessel.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the present invention will now be described with reference to the accompanying drawings in which;

DETAILED DESCRIPTION

The present invention provides an alternative to the chain traditionally used in mooring installations. It provides a flexible elongated tie member to couple vessels to permanently located anchors which simulates the action of a mooring chain, but which is more durable and where the weights used in the apparatus may be reusable.

Figure 1:
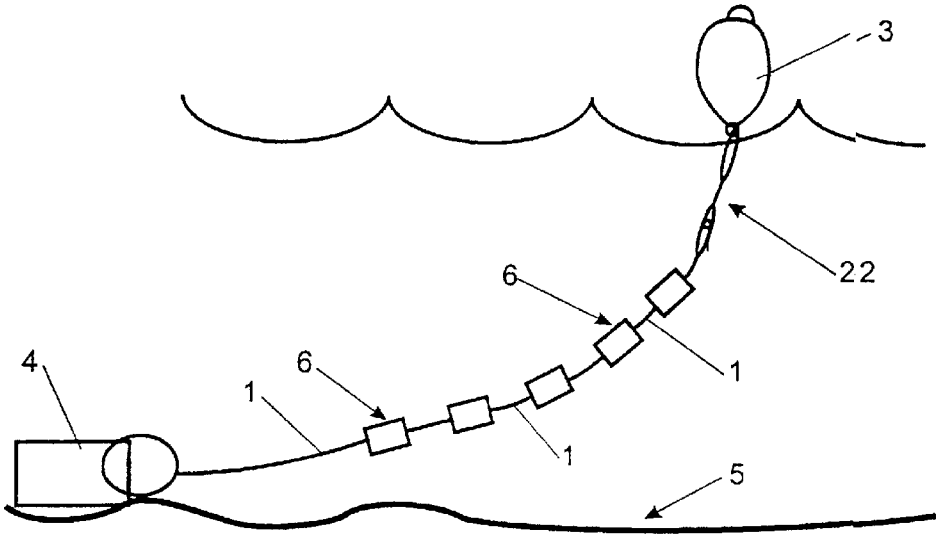
FIG. 1 shows a mooring incorporating a mooring apparatus in accordance with the present invention.

Referring now to FIG. 1, the mooring apparatus in this form has a line 1 preferably being attached at one end through appropriate swivel 22 connections to a buoy 3 and at the other end to an anchor weight 4 which in time will embed into the seabed 5, or the bed of any particular body of water. In the preferred form of the present invention a mooring apparatus is formed by disposing a series of weights 6 along the length of a rope or line 1. Weights 6 are configured as sleeves or part of a sleeve and are either slid along or laterally applied around a rope 1 or an appropriate equivalent. The rope is, in the preferred form, encased itself in an additional plastic hose 3 (see FIG. 4). The rope may be single or multi-strand and is preferably made of a synthetic material but may be made of any appropriate material.

Figure 4:
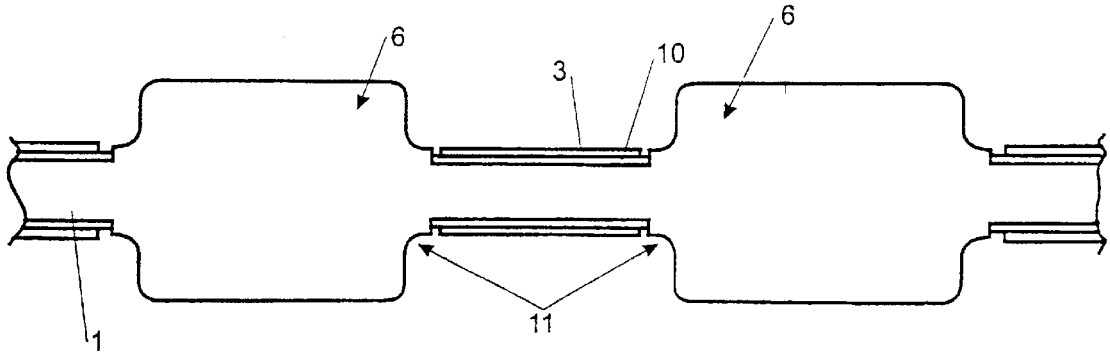
FIG. 4 shows a section of the mooring apparatus illustrating its construction.
Figure 5:
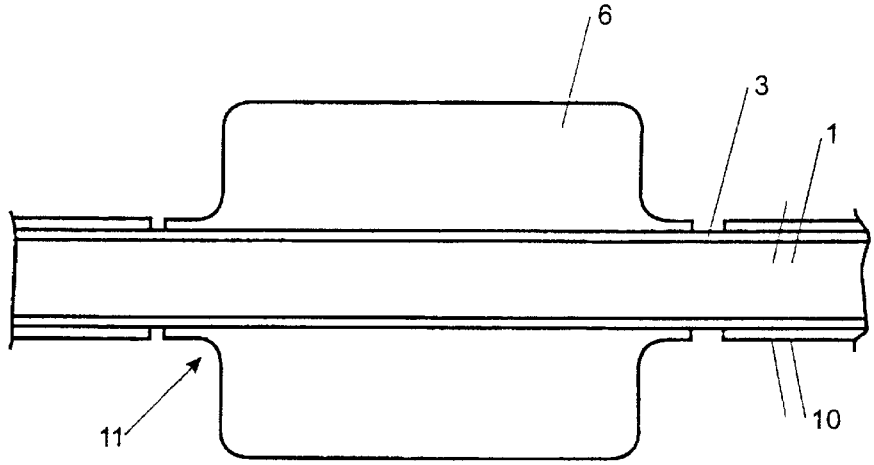
FIG. 5 shows a sectional view of the arrangement of FIG. 4.
Figure 6:
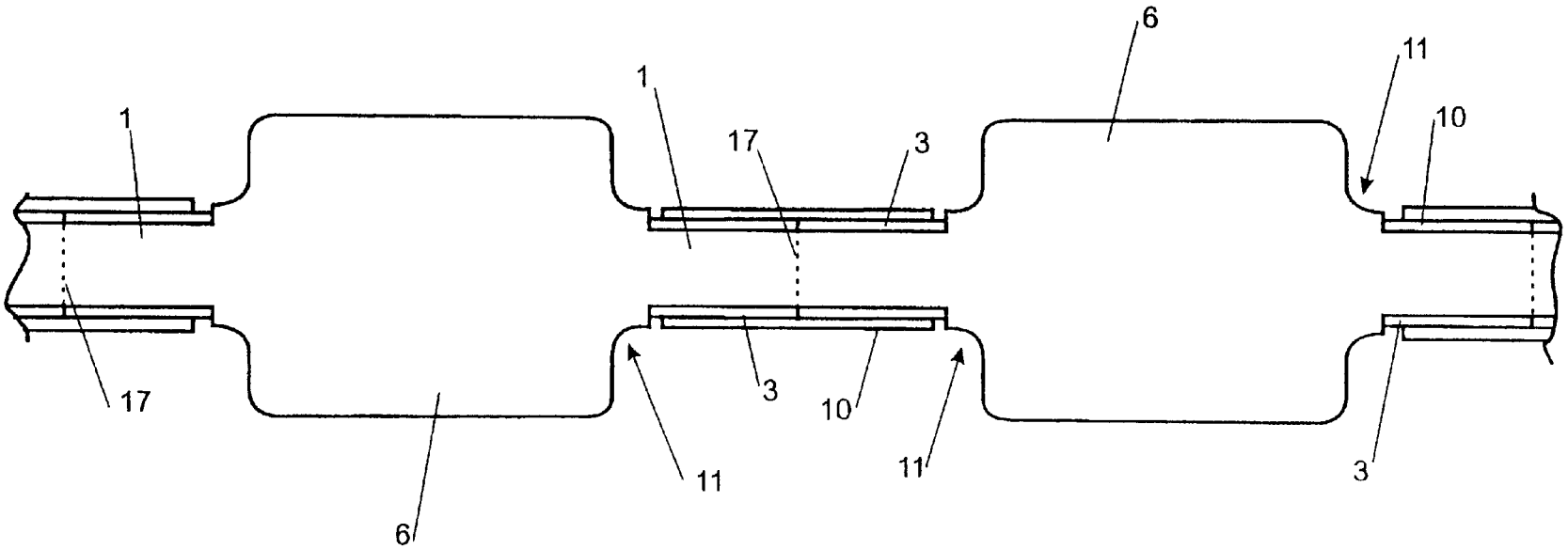
FIG. 6 shows a section of an elongate member encased in plastic hose and with weights attached thereto after being joined to another section of an elongate member, with a sleeve like member covering the joint.

Individual weights 6 are secured preferably by crimping to the plastic hose 3 and rope 1, as shown in FIG. 4. Between the weights 6 spacing sleeves 10 are located (see FIGS. 4 and 5), the sleeves 10 are preferably lengths of plastic tubing. For example, for a light mooring a conventional garden hose may be sufficient to provide the weight spacing. Preferably the weights 6 are lead castings and have axially extending portions 11 at a reduced diameter, which facilitate crimping on to the plastic hose 3 and the rope 1, as shown in FIG. 6. Preferably the form of each weight 6 is such as to enable it to be clamped about the elongate member rather than simply slid along its length although in other forms preferably is in the form of a sleeve like member capable of being moved along the length of the elongate member and spaced from one another by appropriate spacing, for example, those spacings 10 as mentioned above and as shown in FIG. 4. The weights 6 are preferably lead castings that have been coated in plastic to provide extra protection from the water they are placed in when in use in a mooring apparatus of the present invention. Preferably the weights 6 are coated in plastic by being dipped in a hot molten plastic, wherein the plastic is allowed to set before the weight is attached or slid onto the rope.

Figure 2:
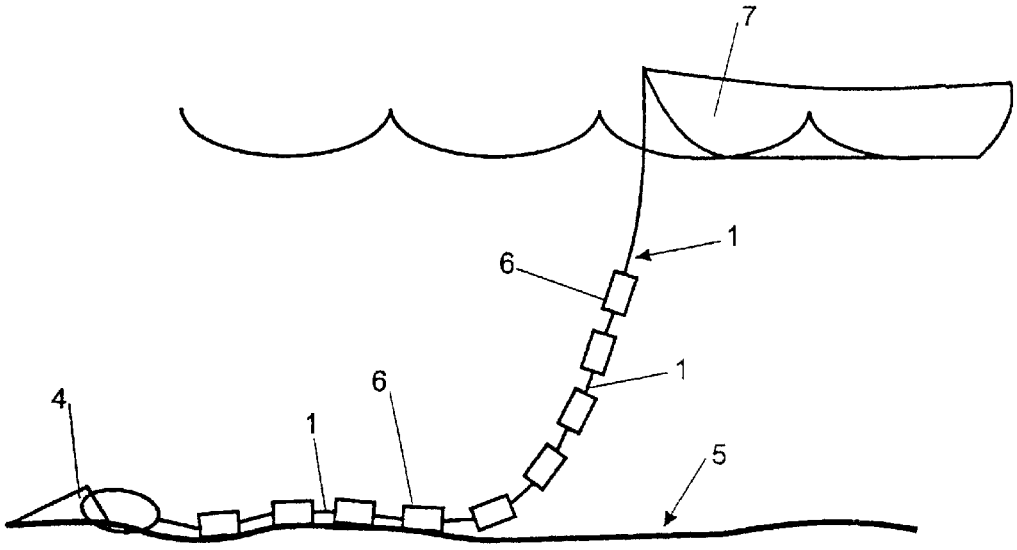
FIG. 2 shows the mooring installation of FIG. 1 securing a vessel.

Referring now to FIG. 2, a mooring apparatus is shown where after a period of time where a boat 7 is tied to the elongate member 1, and the buoy has previously been pulled on board. FIG. 2 shows how over time the end of the rope or line 1 connected to the anchor weight 4 becomes at least partly embedded in the sands, mud, etc of the seabed, whilst the rope or line 1 and weights 6 are able to rise clear of the seabed 5 as and when external force, from the tide, wind or the like act on the vessel moored by the apparatus.

Figure 3:
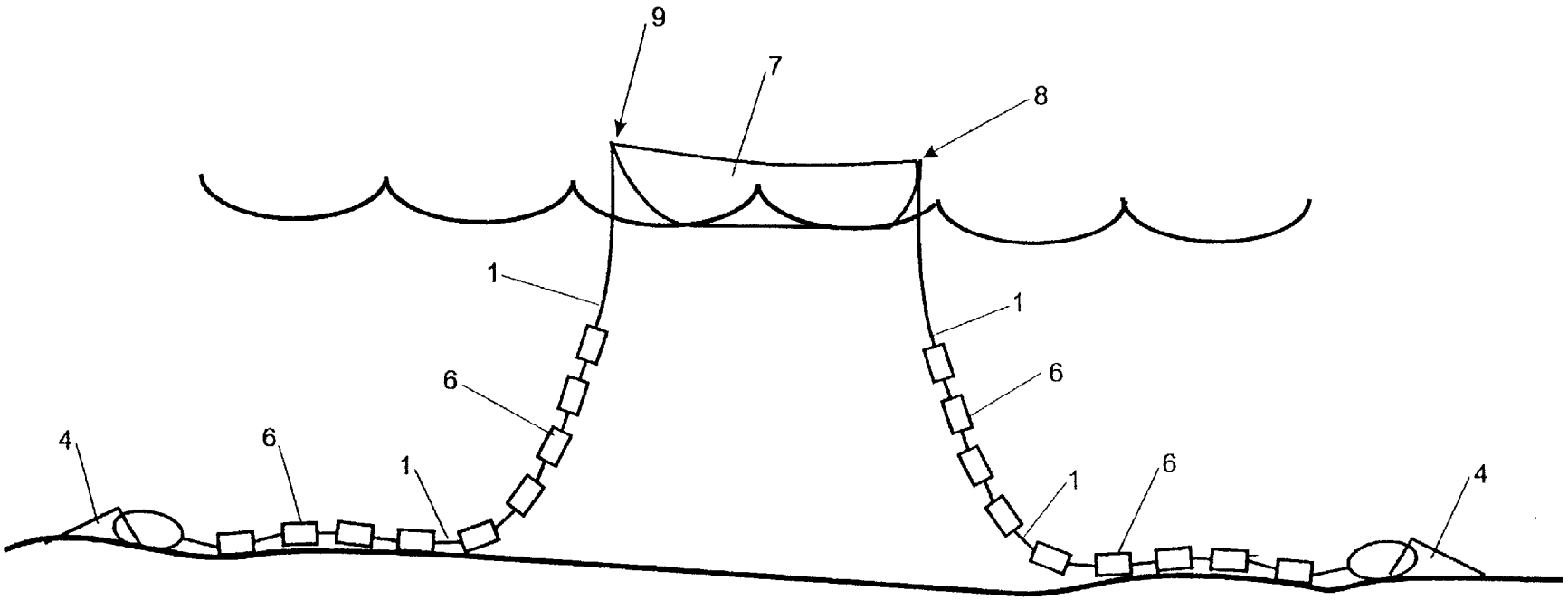
FIG. 3 shows the use of two mooring installations to secure a vessel.

Referring now to FIG. 3, the mooring apparatus arrangement of FIG. 1 is shown after a period of time, where a vessel 7 has been tied to two mooring apparatus, one mooring apparatus is tied to the bow region 8 of the vessel 7 and the other mooring apparatus is tied to the stern region 9 of the vessel 7, creating a fore and aft mooring.

Referring now to FIG. 6, the mooring apparatus may also be constructed of sections, where each section contains a section of rope 1 encased in a plastic tube or hose 3 and a weight 6. The weight 6 is slid along the rope 1 and plastic hose 3 and crimped as previously described to the plastic hose 3 and rope 1. The section is then joined to another such section by way of a vee, splice or any such other appropriate joint, and an additional sleeve 10 is slid over each joint so there is no exposure of the joint 17.

In the preferred form of the present invention where a mooring is to moor, for example, a boat of from 4 to 20 metres in tidal flows between 1 to 10 km/h and a tidal rise between 1 to 6 metres over a season, the rope 1 may be made of nylon of 20 to 60 millimetres in diameter, and the weights 6 are preferably from 5 to 20 kg and spaced apart by between 10 and 100 centimetres. The anchor weight 4 provided with the mooring apparatus is affixed by any appropriate means to the seabed 5 at the end of the mooring apparatus and is preferably from 100 to 800 kgs, but may be up to a weight of 4000 kgs. Preferably the anchor weight 4 is at least 40 times the mass of the weight 6. The form of this anchor weight 4 may be a large concrete, metal or the like block or old car engine blocks.

Other applications of the present invention include mooring floating or marking buoys used as navigational aids, such as beacons, or to mark the position of nets or the like.

Whilst in other forms part of the elongate member, if not all, might be an articulating structure such as a chain, the present invention preferably envisages a non-articulating length of a flexible material such as an appropriate rope, cable or the like.

Figure 7:
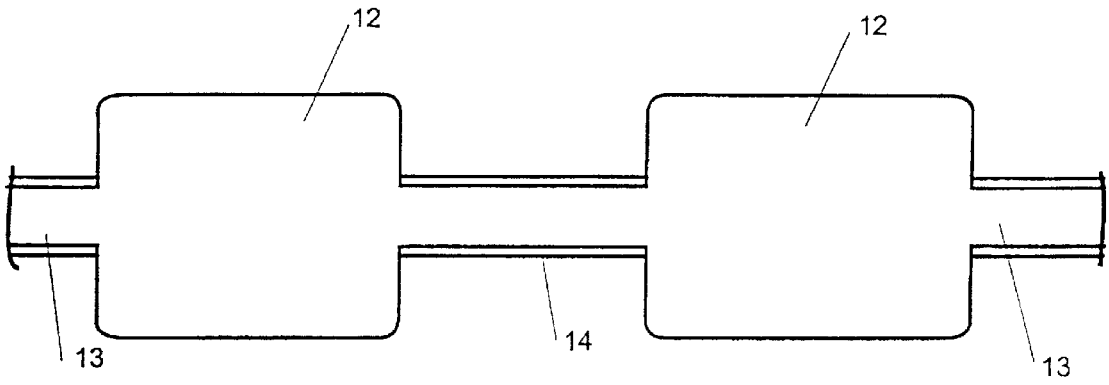
FIG. 7 shows a sectional view of an alternative embodiment of the present invention.
Figure 8:
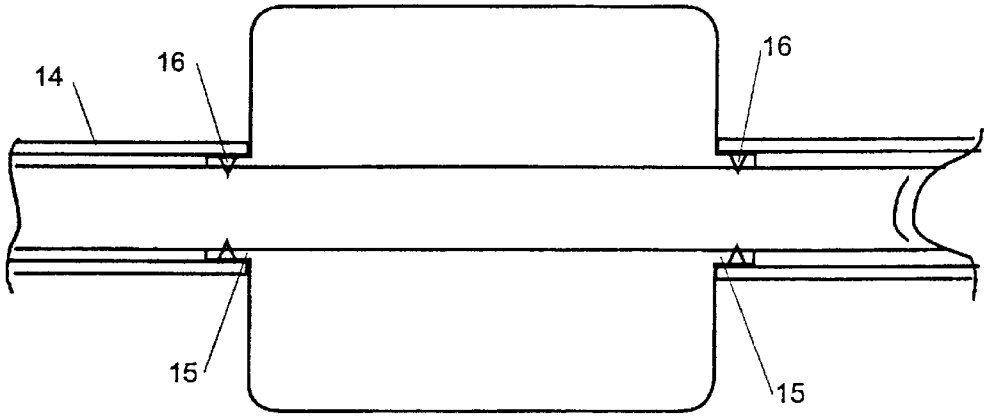
FIG. 8 shows a cross section of the arrangement of FIG. 7.

An alternative form of the present invention is shown in FIGS. 7 and 8. Here the weights 12 are crimped to the rope 13. The weights 12 are interposed with spacing sleeves 14. The weights 12 have extensions 15 away from the main part of the weight 12 that lend themselves to crimping onto the rope 13. This is shown by the triangular sections 16 representing where the lead of the weights is pushed into the rope 13 securing the weight 12 to the rope 13, so as to minimize a tendency for any shirring of the spacing sleeves 14. Preferably the spacing sleeves 14 cover the extensions 15 and crimped area triangular sections 16, as shown in FIG. 8.

A number of mooring apparatus may be attached to a vessel. For example a large vessel may have attached to its bow two mooring apparatus, and a further mooring apparatus may be attached to the stern of the vessel. Here each of the mooring apparatus are attached to their own anchor weight. Therefore, the number of mooring apparatus connected to the vessel provides for a more secure mooring.

When the mooring apparatus of the present invention is required to be replaced the rope 1 and weights 6 may be removed from the water, by pulling the anchor weight 4 and mooring apparatus from the seabed. Once removed the rope and lead weights may be detached from one another and the lead weights reused in a second mooring apparatus or melted down and used in a completely different apparatus or item.

The mooring apparatus of the present invention has the purpose of providing an alternative to chain type mooring apparatus, wherein the present invention is more durable, as the rope and lead weights are less susceptible to corrosion. Furthermore, the mooring apparatus of the present invention, once the rope of line of the apparatus starts to erode, can be removed from the water and the weights removed from the line and reused.

What is claimed is:

1. Mooring apparatus comprising:

a flexible elongate member entirely encased within a flexible tube to form a tube encased elongate member having a first end and a second end, and a plurality of weights each secured and spaced along said tube encased elongate member, said first end adapted to be connected to an anchor weight and said second end adapted to be connected to a buoy, wherein said tube encased elongate member has a plurality of spacing means interspersed between said weights.

2. Mooring apparatus as claimed in claim 1 wherein said elongate member is a rope.

3. Mooring apparatus as claimed in claim 2 wherein said rope is formed from a synthetic material.

4. Mooring apparatus as claimed in claim 2 wherein said elongate member is a nylon rope and said tube is a plastic hose.

5. Mooring apparatus as claimed in claim 1 wherein said plurality of spacing means are sleeves having inner diameters greater than the diameter of said tube encased elongate member.

6. Mooring apparatus as claimed in claim 5 wherein each said sleeve is a section of plastic hose.

7. Mooring apparatus as claimed in claim 1 wherein said anchor weight is at least 40 times the mass of each said weight.

8. Mooring apparatus as claimed in claim 1 wherein each said weight has a mass in the range of from 5 to 20 kgs.

9. Mooring apparatus as claimed in claim 1 wherein each weight comprises two interlocking parts which are clamped onto and about said elongate member.

10. Mooring apparatus as claimed in claim 1 wherein each weight has a necked portion which is crimped onto and about the elongate member.

11. Mooring apparatus as claimed in claim 1 wherein each said weight is a sleeve which is slid and crimped onto said elongate member.

12. Mooring apparatus as claimed in claim 1 wherein said weights are cast lead.

13. Mooring apparatus as claimed in claim 12 wherein said lead weights are plastic coated.

14. Mooring apparatus as claimed in claim 1 wherein said elongate member is made in sections of a tube encased elongate member, each section having at least one said weight clamped onto a respective said section and said sections are attached to one another using joining means, wherein a further sleeve encapsulates the area where each of said section is attached to the next said section.

15. In combination, a mooring apparatus defined in claim 1, and an anchor weight connected to one end thereof and a buoy connected to the other end thereof.

16. A method of forming a mooring apparatus which comprises the steps of:

a) entirely encasing a flexible elongate member within a flexible tube to form a tube encased elongate member having a first end and a second end and locating a plurality of weights on said tube encased elongate member, b) attaching to said first end of said tube encased elongate member an anchor weight, and c) attaching to said second end of said tube encased elongate member a buoy.

17. A method of forming a mooring apparatus as claimed in claim 16 including the step of locating spacing sleeves between said weights.

18. A method of forming a mooring apparatus as claimed in claim 17 wherein the step of locating said weights on said tube encased elongate member is performed by clamping each weight, comprising two interlocking parts, onto and about said tube encased elongate member wherein said spacing sleeve is slid onto said tube encased elongate member interposing each said weight.

19. A method of forming a mooring apparatus as claimed claim 16 wherein the step of locating said weights on said tube encased elongate member is performed by sliding each weight onto said tube encased elongate member wherein said spacing sleeve is slid onto said tube encased elongate member interposing each said weight and each said weight being crimped onto said tube encased elongate member.

20. A method of providing a mooring comprising:

securing to a line or lines one end of at least one flexible elongate member entirely encased within a flexible tube forming a tube encased elongate member having two ends and a plurality of weights each secured and spaced along said tube encased elongate member, securing to the other end of said at least one tube encased elongate member an anchor weight, and securing the line or lines to at least one buoy, which upon hauling onto a vessel enables said at least one tube encased elongate member to be secured to the vessel.

21. A mooring apparatus comprising:

a plurality of flexible elongate members each entirely encased within a flexible tube forming tube encased elongate members having respective first ends and second ends, wherein a plurality of weights is each secured and spaced along each of said tube encased elongate members, and each of said tube encased elongate members each have a plurality of spacing means interspersed between each of said plurality of weights, and said first ends of each of said plurality of tube encased elongate members are adapted to be connected to a respective one of a plurality of anchor weights and said second ends of said plurality of tube encased elongate members are adapted to be connected to a vessel.

* * * * *